US007455000B2

(12) United States Patent
Lucke et al.

(10) Patent No.: US 7,455,000 B2
(45) Date of Patent: Nov. 25, 2008

(54) PLIERS WITH PROTECTED COMPULSORY GUIDE

(75) Inventors: Michael Lucke, Wuppertal (DE); Jürgen Schöneweiβ, Remscheid (DE)

(73) Assignee: Eduard Wille GmbH & Co KG, Wuppertal (DE)

( * ) Notice: Subject to any disclaimer, the term of this patent is extended or adjusted under 35 U.S.C. 154(b) by 0 days.

(21) Appl. No.: 11/713,410

(22) Filed: Mar. 2, 2007

(65) Prior Publication Data

US 2007/0204729 A1 Sep. 6, 2007

(30) Foreign Application Priority Data

Mar. 2, 2006 (DE) ..... 10 2006 010 285

(51) Int. Cl.
*B25B 7/04* (2006.01)

(52) U.S. Cl. ..... 81/412

(58) Field of Classification Search ..... 81/405, 81/407, 355, 356, 358, 360, 408–413, 427
See application file for complete search history.

(56) References Cited

U.S. PATENT DOCUMENTS

| | | | | | |
|---|---|---|---|---|---|
| 1,508,510 | A | * | 9/1924 | Edwards | 81/356 |
| 1,540,464 | A | * | 6/1925 | Edwards | 81/356 |
| 2,844,061 | A | * | 7/1958 | Hendrickson | 81/356 |
| 3,161,094 | A | * | 12/1964 | Johnson | 81/412 |
| 3,534,641 | A | * | 10/1970 | Le Duc | 81/357 |
| 4,296,655 | A | * | 10/1981 | Tesoro | 81/405 |
| 4,581,960 | A | * | 4/1986 | Putsch et al. | 81/411 |
| 5,176,049 | A | * | 1/1993 | Neff | 81/360 |

FOREIGN PATENT DOCUMENTS

| | | | |
|---|---|---|---|
| DE | 282 732 | | 3/1915 |
| DE | 819 380 | | 11/1951 |
| DE | 931 640 | | 6/1956 |
| DE | 1 742 395 | | 8/1957 |
| DE | 3102390 | A1 * | 1/1983 |
| DE | 296 20 588 | | 5/1997 |
| DE | 196 03 507 | | 8/1997 |
| DE | EP 0 824 996 | | 9/2001 |
| DE | 10 2004 022 943 | | 12/2005 |
| EP | 421107 | A2 * | 4/1991 |

* cited by examiner

*Primary Examiner*—Hadi Shakeri
(74) *Attorney, Agent, or Firm*—Lawrence G. Fridmar

(57) ABSTRACT

The invention relates to pliers with a variable sized wrench, in particular to a water pump pliers with a first and a second gripper arms pivotably connected around a pivot pin. The first gripper arm is provided with an integrated pliers jaw. A pliers jaw movable about a joint is provided at the second gripper arm. The movable pliers jaw of the second gripper arm is provided with guiding means for adjustably guiding the movable pliers jaw together with the second gripper arm in a compulsory guide of the first gripper arm. A detent mechanism for locking is provided for keeping the movable pliers jaw with the second gripper arm in a detent position for a rough adjustment.

10 Claims, 3 Drawing Sheets

PLIERS WITH PROTECTED COMPULSORY GUIDE

FIELD OF THE INVENTION

The invention relates to pliers with a variable sized wrench, in particular to water pump pliers with a first and a second gripper arm pivotably connected around a pivot pin.

BACKGROUND OF THE INVENTION

Pliers are a two-legged tool where the effective spots are pressed against each other. Basically, pliers consist of three components, i.e. the handles, the joint and they pliers head. They operate according to the lever principle. Two two-sided levers are interconnected by a joint. Usually the handles form the longer lever arms; the shorter lever arms form the pliers head. The manual power affected on the handles is amplified according to the law of the lever and transferred to the work piece by means of the pliers head.

Pliers related to by the present invention are used in various applications and especially used in the form of water pump pliers. Water pump pliers are gripping pliers, with an adjustable sliding joint, so that opening widths of the opening can be adjusted in various sizes. They are mainly used for gripping pipes, bushings and screws/nuts of different kinds, but also for flats etc.

Key pliers are known from the European Patent specification EP 0 421 107. Key pliers with two pliers jaws forming the pliers opening are described in this publication. One of the pliers jaws tightly abuts a pliers arm which is provided with a longitudinal slot guiding for a pliers leg pivot pin to roughly adjust the pliers opening. A fork-shaped, movable jaw for encompassing the fixed pliers leg is shiftably guided in a guiding groove at the pliers leg carrying the fixed pliers jaw. A power transmission spot between a shoulder of the shiftable pliers jaw and the jaw-side arm of the movable pliers leg is adapted to be displaced to close the pliers opening. The power transmission spot in the form of a form-fit engagement between the jaw-side arm and the movable pliers jaw is the interconnecting spot for the rough longitudinal adjustment as well as for the closing of the pliers opening between the pliers leg and the movable jaw.

The US patent specification U.S. Pat. No. 3,534,641 discloses a pliers consisting of two gripper arms. A first pliers jaw is integrated in a first gripper arm. A second pliers jaw is shiftably arranged on one side of the first gripper arm. For this purpose the first gripper arm is provided with a section with an abutment surface perpendicular to the pivot axis of the pliers. The second pliers jaw is designed to encompass the abutment surface of the first gripper arm with a groove-shaped abutment surface. Furthermore, a detent slot is provided in the first gripper arm wherein a pivot pin in the form of a screw is provided, the pivot pin having a detent mechanism. The second gripper arm engages the second movable pliers jaw at this pivot pin for the power transmission. While the second gripper arm is arranged on the one side of the first gripper arm the second pliers jaw is correspondingly provided on the opposite side of the first gripper arm. The second gripper arm can be adjusted with the second pliers jaw in the detent slot for rough adjustment. By activating the pliers the second pliers jaw is shifted along the section for power transmission according to the lever path.

The known pliers have the disadvantage, that they have many spots, where a user can pinch himself during gripping, for example at the rough adjustment of the pliers.

SUMMARY OF THE INVENTION

One of the objects of the invention is to improve known pliers and prevent injuries of the user.

According to the invention this object is achieved by providing pliers with variable opening size, especially water pump pliers, with a first and a second gripper arm interconnected pivotably about a pivot pin of the above mentioned kind, the compulsory guide for the movable pliers jaw is formed by:

- two plane abutment surfaces parallel with respect to the pivot axis of the pliers and sideways opposite positioned at the first gripper arm,
- a corresponding plane abutment surface at the movable pliers jaw,
- a corresponding opposite plane abutment surface at a guiding lug integrated in the movable pliers jaw, and
- a longitudinal slot through the first gripper arm to guide the second gripper arm.

The invention is based on the principle to design a compulsory guide in such a way that the guiding of the movable pliers jaw is mainly protected. This is particularly achieved in that the second pliers jaw and the movable pliers jaw are guided in a longitudinal slot protecting the user to a large extent of clamping injuries. The longitudinal slot covers the portions of the pliers, where a user can be injured as much as possible especially during adjustment of the pliers. Furthermore, the compulsory guide is shifted to areas, which do not contact the user during adjustment or when the pliers are operated.

It has been proven to be an advantageous modification of the invention if the pivot pin of the pliers according to the invention is guided in a slot parallel to the compulsory guide. By this measure an additional stability of the pliers is achieved by an even distribution of the power.

According to a preferred modification of the pliers according to the invention the detent mechanism is formed by the slot parallel to the compulsory guide and by at least one detent tooth provided at the pivot pin. In order to roughly adjust the pliers the pliers is roughly adjusted to a suitable opening width. The adjustment is carried out by shifting the pivot pin in the slot parallel to the compulsory guide. The detent tooth supports the pivot pin to be fixed in a position, for example by wedging. Preferably the slot parallel to the compulsory guide is provided with a toothing for detent of the detent tooth stabilizing the detent mechanism.

Furthermore the pliers according to the present invention are advantageously designed in that the detent mechanism is provided on two opposite sides of the longitudinal slot. By this measure it is additionally achieved that the power is not distributed on one side of the longitudinal slot, but symmetrically on both opposite sides, of the longitudinal slot. In a one-side detent mechanism the power is transmitted to one side of the longitudinal slot, which can lead to deformations at strong strain due to the asymmetry. With the symmetrical arrangement an even strain of the pliers is affected leading to an increased life time of the pliers.

Furthermore, according to an advantageous modification of the invention the detent mechanism is biased with a spring. Thereby the detent mechanism cannot be easily released from its position. In order to adjust the pliers for the rough adjustment it is, therefore, always necessary to unlock the detent mechanism against the spring power. The user of the tool cannot be injured as easily as before, when the detent mechanism is accidentally released during operation, whereby pinching or slipping-off of the pliers can occur.

It is, furthermore, advantageous with the pliers according to the present invention, if the joint between the second gripper arm and the second movable pliers jaw is formed by an integrated shoulder-shaped projection an end of the second gripper arm engaging a suitable recess of the second pliers jaw for the transmission of power. By this measure a joint is achieved, which is easy to produce and which satisfies the requirements for the power transmission.

A preferred variation of the pliers according to the present invention finally results, if the joint between the second gripper arm and the second movable pliers jaw is covered by protective means towards the outside. By a protective coat, for example, it is not only avoided that dirt enters the joint, but also that a region is protected where a user of the pliers could pinch himself.

The advantageous features of the invention are illustrated in the accompanying drawings.

DESCRIPTION OF THE EMBODIMENTS OF THE INVENTION

Figure 1:
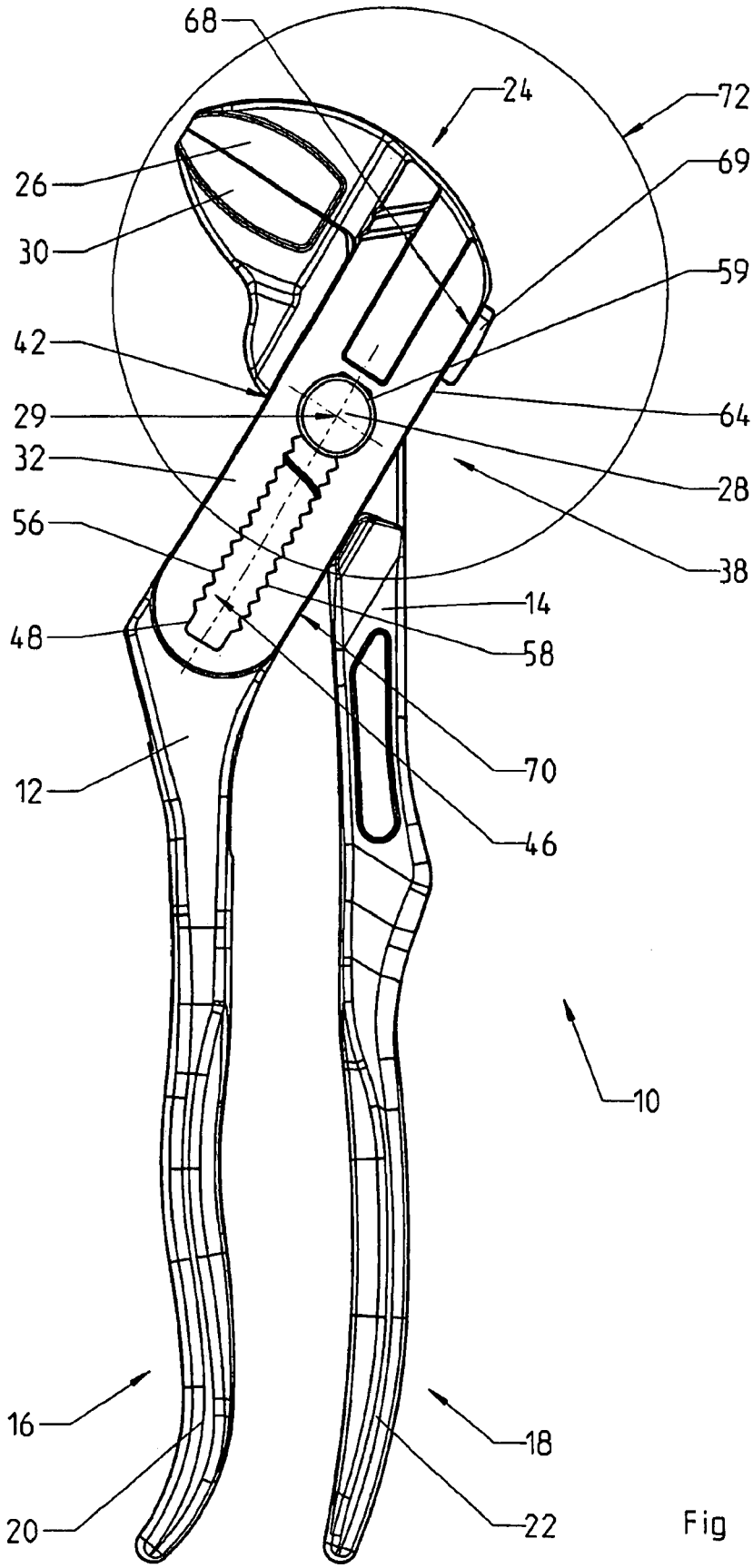
FIG. 1 shows a side view of the pliers according to the present invention.

In FIG. 1 a side view of pliers 10 according to the present invention is illustrated. The pliers 10 are provided with a first gripper arm 12 and a second gripper arm 14. Each gripper arm 12 and 14 is provided with a handle 20, 22 at a gripping end 16, 18. At the end 24 remote from the gripping handle of the first gripper arm 12 a first pliers jaw 26 is tightly integrated. The second gripper arm 14 is pivotably connected about a pivot pin 28 to the first gripper arm 12. A pivot axis 29 is defined by the pivot pin 28, see FIG. 3.

A second pliers jaw 30 is shiftably guided in a section 32 of the first gripper arm 12. The second gripper arm 14 and the second pliers jaw 30 are movably interconnected by a joint 34. The joint 34 consists of a recess 36 and a shoulder-shaped projection 40 integrated into the end 38 remote from the gripper handle of the second gripper arm 14, as it becomes obvious from FIG. 2.

In a section 32 the first gripper arm 12 is provided with a longitudinal slot 42 which is perpendicular to the pivot axis 29. The second gripper arm 14 and a guiding lug 44 integrated into the second pliers jaw 30 are guided through this longitudinal slot 42.

The first gripper arm 12 is, furthermore, provided with a detent mechanism 46. The detent mechanism 46 is formed by the pivot pin 28 and two detent slots 48, 50. The two detent slots 48, 50 are positioned on opposite sides 52, 54 of the longitudinal slot 42. The detent slots 48, 50 are provided with teeth 56, 58 engaging a detent tooth assembly 60 for detent. The detent toot assembly 60 is spring biased provided at the pivot pin 28. In order to effect a rough adjustment of the pliers 10 the detent tooth assembly 60 is removed from the teeth 56, 58 against the spring power with a suitably provided pressure knob 59. The pivot pin 28 may then be shifted with the second gripper arm 14 and the second movable pliers jaw 30 within the detent slots 48, 50. Due to the biasing power of the spring 74 the detent tooth assembly 60 of the pivot pin 28 is set back into the teeth 56, 58 of the detent slots 48, 50. In such a way the desired rough adjustment of the second gripper arm 14 with respect to the first gripper arm 12 can be carried out.

The longitudinal slot 42 of the first gripper arm 12 is provided with two pairs of opposite bearing surfaces 62, 64. The bearing surfaces 62, 64 run parallel to the pivot axis 29 and parallel to the detent slots 48, 50. The plane bearing surfaces 62, 64 provided on the front and rear side of the first gripper arm 12 each surround the longitudinal slot 42 on its side. The second movable pliers jaw 30 has a first pair of abutment surfaces 66 on the side of the longitudinal slot 42 in the form of a projection. The guiding lug 44 extending through the longitudinal slot 42 has a corresponding second pair of abutment surfaces 68 which is also designed as a button-like projection 69. The abutment surfaces 68 is directed towards the abutment surfaces 64.

The bearing surfaces 62, 64 together with the abutment surfaces 66, 68 form a compulsory guide 70. The compulsory guide 70 ensures that the movable second pliers jaw 30 can slide only along the bearing surfaces 62, 64—like on a track.

Figure 2:
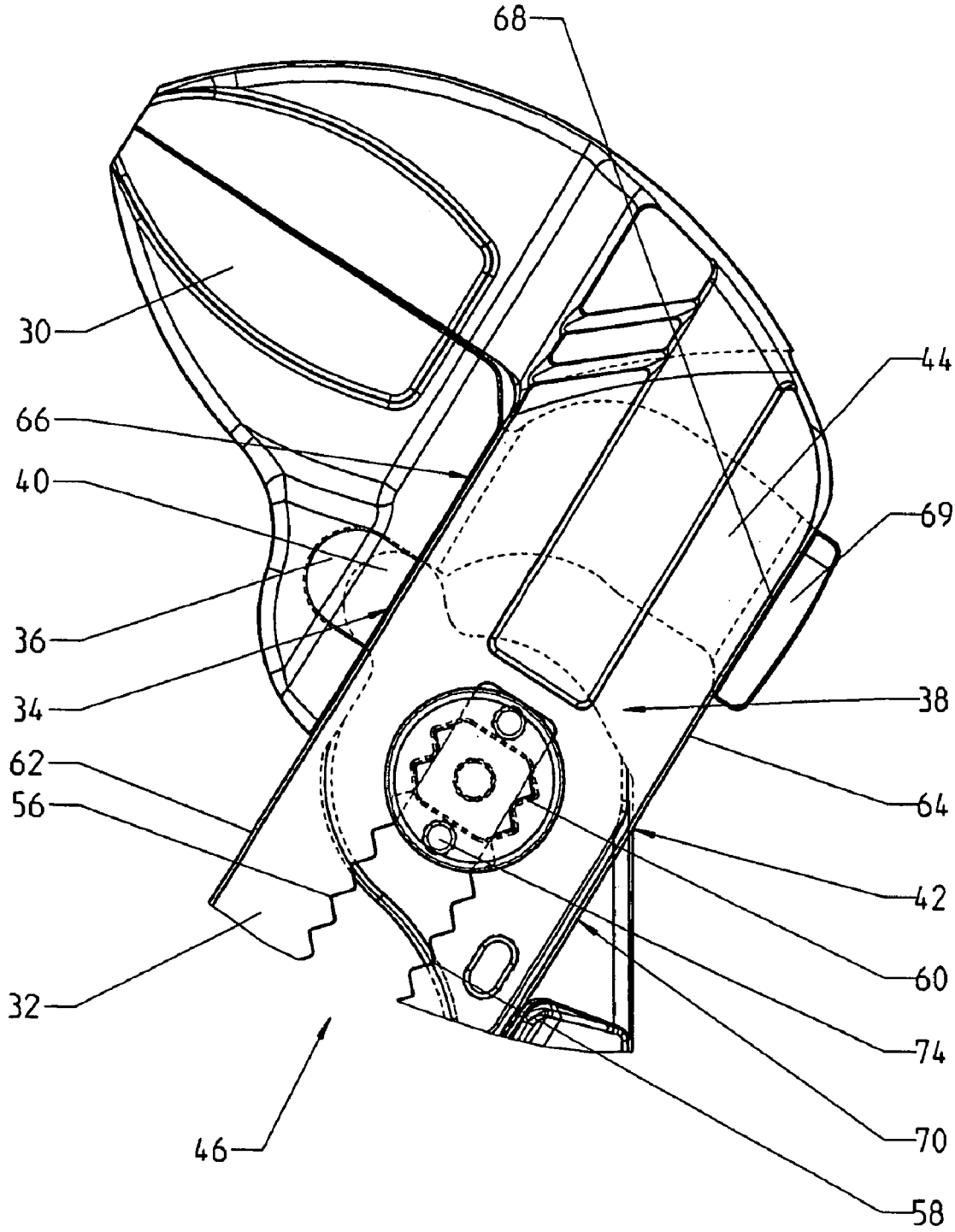
FIG. 2 shows an enlarged view of the portion of the pliers illustrated on FIG. 1.

In FIG. 1 an area is marked with a circle 72, which is shown in FIG. 2 in an enlarged version. A portion of the section 32 is shown in this representation with a portion of the pliers jaws 26, 30 pressed together. The second movable pliers jaw 30 shows the integrated guiding lug 44 guided through the longitudinal slot 42. The abutment surface 68 in the form of a button-like projection 69 can bee seen at an end of the guiding lug 44 projecting from the longitudinal slot 42. The abutment surface 66 and the abutment surface 68 guide the second movable pliers jaw 30 along the bearing surfaces 62, 64 in the section 32 of the first gripper arm 12. Thereby the second pliers jaw 30 is supported by compulsory guide 70 formed in such way.

The gripper arms 12, 14 are pivoted about the pivot pin 28 for producing the lever power effective on the pliers jaws 26, 30. For this purpose the second gripper arm 14 engages the joint connection 34 consisting of the integrated shoulder-shaped projection 40 and the recess 36. The second pliers jaw 30 is guided only along the compulsory guide 70 when the tool is operated. The joint 34 requires a corresponding gap in the recess 36 in order to enable these movements. The recesses 36 are normally not visible and covered towards the outside, especially to avoid pinching injuries and dirt.

In FIG. 2 also the detent mechanism 46 for the rough adjustment becomes apparent by the enlarged representation. The pivot pin 28 is adjustably guided by the guide formed by the two opposite detent slots 48, 50. The detent tooth assembly 60 is produced in such a way that they engage the toothing 56, 58 of the detent slots 48, 50 in the locked state. The detent tooth assembly 60 is biased with springs 74. By operating the button 59 the detent tooth assembly 60 is pushed out of the toothing 56, 58. Thereby the pivot pin 28 can be moved back and forth in the detent slots 48, 50 for rough adjustment. By releasing the press button 59 the detent tooth assembly 60 locks in any detent position for the desired pliers opening size.

Figure 3:
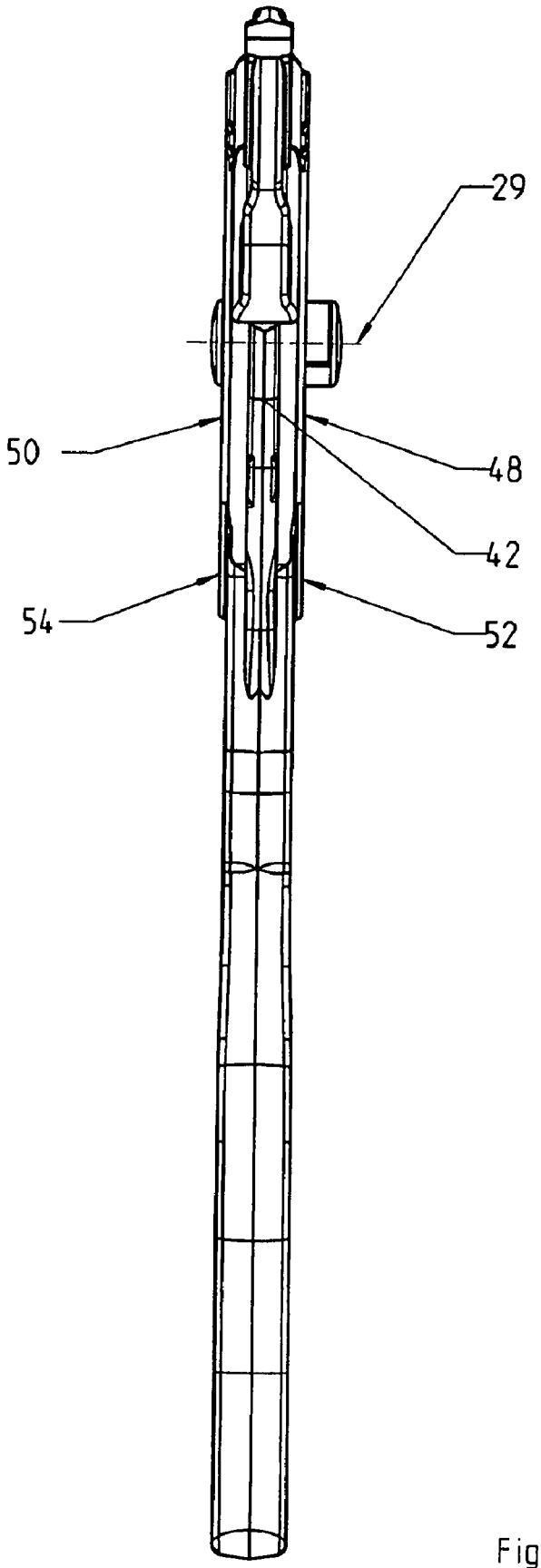
FIG. 3 shows a front view of the pliers according to the present invention.

FIG. 3 is a front view in a schematic principle sketch of the pliers 10 according to the present invention. With this drawing it shall mainly be highlighted, that the longitudinal slot 42 is formed by the first gripper arm 12 the second gripper arm 14 extending therethrough. The gripper arms 12 and 14 are pivotable about the pivot axis 29 formed by the pivot pin 28 in order to operate the tool. The same components of the pliers 10 are denoted otherwise with the corresponding numerals as in the previous figures.

What is claimed is:

1. Pliers with variable size of wrench, comprising:

a first gripper arm with an integrated pliers jaw;

a second gripper arm operatively connected with a movable pliers jaw;

the gripper arms movably interconnected to each other;

a detent mechanism for locking being adapted for keeping the movable pliers jaw with the second gripper arm in a detent position for an initial adjustment;

a first bearing contact formed at a front side and a second bearing contact formed at a rear side of the first arm, a longitudinal slot passing through the first gripper arm between the first and second bearing contacts defining a first pair of gripping surfaces at the front side and a second pair of gripping surfaces at the rear side;

the second jaw movable about the first gripper arm and a projection disposed rearwardly of the second jaw, a guiding lug extending between the second jaw and the projection wherein the projection and the guiding lug together define a button-like projection with a T-shaped cross section, the guiding lug passing through the longitudinal slot of the first gripper arm, the second jaw having a first abutment surface facing the first pair of bearing surfaces, the button-like projection having a second pair of abutment surfaces facing the second pair of bearing surfaces; and the first pair of bearing surfaces cooperating with the first abutment surface, the second pair of abutment surfaces is adapted for slidable cooperation with the second pair of bearing surfaces of the first gripper arm, so as to guide the movement of the second jaw along the first gripping arm.

2. The pliers with variable size of wrench according to claim 1, wherein said first and second gripper arms are pivotably connected at a pivot pin, the pivot pin is guided within a slot disposed substantially parallel to the bearing surfaces.

3. The pliers with variable size of wrench according to claim 2, wherein the detent mechanism is provided on two opposite sides of the parallel slot.

4. The pliers with variable size of wrench according to claim 2, wherein the detent mechanism is biased with a spring.

5. The pliers with variable size of wrench according to claim 1, wherein the detent mechanism is formed by a slot disposed substantially parallel to the bearing surfaces and by at least one detent tooth provided at a pivot pin.

6. The pliers with variable size of wrench according to claim 5, wherein the substantially parallel slot is provided with a toothing for engaging the detent tooth.

7. The pliers with variable size of wrench according to claim 1, wherein a joint between the second gripper arm and the second movable jaw is formed by an integrated shoulder-shaped projection at an end of the second gripper arm engaging a recess formed in the second jaw for transmission of power therebetween.

8. The pliers with variable size of wrench according to claim 7, wherein the joint between the second gripper arm and the second movable jaw is covered.

9. The pliers with variable size of wrench according to claim 1, wherein said pliers are water pump pliers.

10. The pliers with variable size of wrench according to claim 1, wherein during the movement of the second jaw along the first gripping arm, the guiding lug is guided by the longitudinal slot.

* * * * *